US010337110B2

(12) United States Patent
Markowz et al.

(10) Patent No.: US 10,337,110 B2
(45) Date of Patent: Jul. 2, 2019

(54) DEVICE AND METHOD FOR THE FLEXIBLE USE OF ELECTRICITY

(71) Applicant: Covestro Deutschland AG, Leverkusen (DE)

(72) Inventors: Georg Markowz, Alzenau (DE); Imad Moussallem, Hanau (DE); Rüdiger Schütte, Alzenau-Hörstein (DE); Jürgen Erwin Lang, Karlsruhe (DE)

(73) Assignee: Covestro Deutschland AG, Leverkusen (DE)

( * ) Notice: Subject to any disclaimer, the term of this patent is extended or adjusted under 35 U.S.C. 154(b) by 329 days.

(21) Appl. No.: 15/101,296

(22) PCT Filed: Nov. 28, 2014

(86) PCT No.: PCT/EP2014/075881
§ 371 (c)(1),
(2) Date: Jun. 2, 2016

(87) PCT Pub. No.: WO2015/082319
PCT Pub. Date: Jun. 11, 2015

(65) Prior Publication Data

US 2016/0305030 A1 Oct. 20, 2016

(30) Foreign Application Priority Data

Dec. 4, 2013 (DE) ..... 10 2013 224 872

(51) Int. Cl.

| | |
|---|---|
| ***C25B 1/46*** | (2006.01) |
| ***C25B 9/00*** | (2006.01) |
| ***C25B 9/10*** | (2006.01) |
| ***C25B 9/18*** | (2006.01) |
| ***C25B 15/02*** | (2006.01) |

(52) U.S. Cl.
CPC ..... *C25B 1/46* (2013.01); *C25B 9/00* (2013.01); *C25B 9/10* (2013.01); *C25B 9/18* (2013.01); *C25B 15/02* (2013.01)

(58) Field of Classification Search
CPC ..... C25B 1/46; C25B 15/02
See application file for complete search history.

(56) References Cited

U.S. PATENT DOCUMENTS

| | | | |
|---|---|---|---|
| 1,481,357 | A | 1/1924 | Dwight |
| 2,048,112 | A | 7/1936 | Gahl |
| 2,899,275 | A | 8/1959 | Cherrier |
| 2,997,434 | A | 8/1961 | Gäbler et al. |
| 3,622,493 | A | 11/1971 | Crusco |
| 3,674,668 | A | 7/1972 | Bjornson et al. |
| 4,144,444 | A | 3/1979 | Dementiev et al. |
| 4,217,186 | A | 8/1980 | McRae |
| 4,364,806 | A | 12/1982 | Rogers |
| 4,588,850 | A | 5/1986 | Mueller et al. |
| 4,808,290 | A | 2/1989 | Hilbig |
| 5,411,641 | A | 5/1995 | Trainham et al. |
| 5,470,541 | A | 11/1995 | Koch et al. |
| 5,529,669 | A | 6/1996 | Koch et al. |
| 5,693,202 | A | 12/1997 | Gestermann et al. |
| 5,958,197 | A | 9/1999 | Allen et al. |
| 6,033,549 | A | 3/2000 | Peinecke et al. |
| 6,745,105 | B1 | 6/2004 | Farlie et al. |
| 7,928,275 | B2 | 4/2011 | Bachtler et al. |
| 7,955,490 | B2 | 6/2011 | Fang et al. |
| 8,017,823 | B2 | 9/2011 | Ehrhardt et al. |
| 8,850,826 | B2 | 10/2014 | Ennis |
| 8,912,748 | B2 | 12/2014 | Hiebl |
| 9,051,526 | B2 | 6/2015 | Markowz |
| 9,057,138 | B2 | 6/2015 | Stuermer et al. |
| 9,243,337 | B2 | 1/2016 | Turek et al. |
| 2002/0000085 | A1 | 1/2002 | Hall et al. |
| 2003/0065042 | A1 | 4/2003 | Shaw |
| 2003/0118489 | A1 | 6/2003 | Hagan et al. |
| 2005/0000798 | A1* | 1/2005 | Faita ..... C25B 9/08 204/242 |
| 2005/0065391 | A1 | 3/2005 | Gattis et al. |
| 2005/0238933 | A1 | 10/2005 | Kim et al. |

(Continued)

FOREIGN PATENT DOCUMENTS

| | | |
|---|---|---|
| DE | 292 920 | 8/1991 |
| DE | 43 32 789 | 3/1995 |

(Continued)

OTHER PUBLICATIONS

English language abstract for KR 10-1079470 filed Nov. 11, 2011.
English language translation of the International Search Report for corresponding international application PCT/2014/075881 filed Nov. 28, 2014.
English language translation of the Written Opinion of the International Searching Authority for corresponding international application PCT/2014/075881 filed Nov. 28, 2014.
English language translation of the International Preliminary Report on Patentability for corresponding international application PCT/2014/075881 filed Nov. 28, 2014.
European Search Report for DE 10 2013 224 872, (priority application to corresponding international application PCT/2014/075881 filed Nov. 28, 2014), with partial machine translation of numbered paragraphs 2-4 attached.

(Continued)

*Primary Examiner* — Nicholas A Smith
(74) *Attorney, Agent, or Firm* — Law Office of: Michael A. Sanzo, LLC

(57) ABSTRACT

An apparatus for chlor-alkali electrolysis, comprising a cathode half-cell, an oxygen-consuming electrode arranged therein, a conduit for supply of gaseous oxygen to the cathode half-cell and a conduit for purging the cathode half-cell with inert gas, enables the flexible use of power by a method in which chlorine is produced in the apparatus by chlor-alkali electrolysis, wherein, when power supply is low, the oxygen-consuming electrode is supplied with gaseous oxygen, and oxygen is reduced at the oxygen-consuming electrode at a first cell voltage, and when power supply is high, the oxygen-consuming electrode is not supplied with any oxygen, and hydrogen is generated at the cathode at a second cell voltage which is higher than the first cell voltage.

20 Claims, No Drawings

(56) References Cited

U.S. PATENT DOCUMENTS

| | | | | |
|---|---|---|---|---|
| 2007/0020173 | A1 | 1/2007 | Repasky et al. | |
| 2007/0202037 | A1 | 8/2007 | Golden et al. | |
| 2007/0216165 | A1 | 9/2007 | Oohara et al. | |
| 2007/0238910 | A1 | 10/2007 | Ehrhardt et al. | |
| 2009/0008261 | A1 | 1/2009 | Kotzeva et al. | |
| 2009/0023970 | A1 | 1/2009 | Bachtles et al. | |
| 2009/0048716 | A1 | 2/2009 | Marhoefer et al. | |
| 2010/0177861 | A1 | 7/2010 | Lecomte et al. | |
| 2012/0000789 | A1 | 1/2012 | Turek et al. | |
| 2012/0052402 | A1 | 3/2012 | Turek et al. | |
| 2012/0085659 | A1* | 4/2012 | Bachleitner | C25B 1/26 205/620 |
| 2012/0091730 | A1 | 4/2012 | Stuermer et al. | |
| 2012/0139473 | A1 | 6/2012 | Hiebl et al. | |
| 2012/0145537 | A1* | 6/2012 | Kuiphoff | C25B 1/46 204/237 |
| 2013/0216457 | A1 | 8/2013 | McAlister | |
| 2013/0317959 | A1* | 11/2013 | Joos | C25B 15/02 705/34 |
| 2015/0298093 | A1 | 10/2015 | Markowz et al. | |
| 2015/0315936 | A1 | 11/2015 | Markowz et al. | |
| 2015/0352481 | A1 | 12/2015 | Forsyth et al. | |
| 2016/0068404 | A1 | 3/2016 | Caton et al. | |
| 2016/0108809 | A1 | 4/2016 | Markowz et al. | |
| 2016/0122194 | A1 | 5/2016 | Markowz et al. | |
| 2016/0136608 | A1 | 5/2016 | Markowz et al. | |
| 2016/0221892 | A1 | 8/2016 | Markowz et al. | |
| 2016/0312369 | A1 | 10/2016 | Moussallem et al. | |
| 2017/0022578 | A1 | 1/2017 | Markowz et al. | |

FOREIGN PATENT DOCUMENTS

| | | |
|---|---|---|
| DE | 196 22 744 | 7/1997 |
| DE | 10 2009 048 455 | 4/2011 |
| DE | 10 2010 017 027 | 6/2011 |
| EP | 0 064 874 | 5/1982 |
| EP | 1 067 217 | 1/2001 |
| GB | 780 080 | 7/1957 |
| GB | 1 000 480 | 8/1965 |
| GB | 1 400 266 | 7/1975 |
| JP | 2002-243100 | 8/2002 |
| KR | 10-1079470 | 11/2011 |
| WO | WO 93/20153 | 10/1993 |
| WO | WO 95/21126 | 8/1995 |
| WO | WO 02/26378 | 4/2002 |
| WO | WO 02/054561 | 7/2002 |
| WO | WO 2004/091773 | 10/2004 |
| WO | WO 2007/021172 | 2/2007 |
| WO | WO 2013/029701 | 3/2013 |
| WO | WO 2014/191147 | 12/2014 |
| WO | WO 2014/191148 | 12/2014 |
| WO | WO 2014/202314 | 12/2014 |

OTHER PUBLICATIONS

English language translation of the International Search Report for international application PCT/2014/077870 filed Dec. 16, 2014 (corresponds to copending U.S. Appl. No. 15/104,969).

English language translation of the Written Opinion of the International Searching Authority for international application PCT/2014/077870 filed Dec. 16, 2014 (corresponds to copending U.S. Appl. No. 15/104,969).

English language translation of the International Preliminary Report on Patentability for international application PCT/2014/077870 filed Dec. 16, 2014 (corresponds to copending U.S. Appl. No. 15/104,969).

European Search Report for DE 10 2013 226 414, (priority application to corresponding international application PCT/2014/077870 filed Dec. 16, 2014), with partial machine translation of portions of numbered paragraphs 2-4 attached.

Henkel, et al., "Economic efficiency and Their Industrial Applications," Ulmann's Encylopedia of Industrial Chemistry, Weinheim VCH Verlag DE., pp. 87-120 (Jan. 1, 1992).

Ingenieur.de, "Chemieanlagen könnten ala Stromspeicher und Puffer dienen," *Energiewirtschaft* , Jun. 12, 2016 (with machine translation attached).

Moussallem, et al., "Chlor-alkali electrolysis with oxygen depolarized cathodes: history, present status and future prospects," *J. Appl. Electrochem.* 38:1177-1194 (May 2008).

Obara, et al., "Economic efficiency of a renewable energy independent microgrid with energy storage by a sodium-sulfur battery or organic chemical hydride," *International Journal of Hydrogen Energy* 38:8888-8902 (Jul. 2013).

Ulmann's Encylopedia of Industrial Chemistry, Wiley-VCH Verlag GmbH & Co. KGaA, Weinheim, vol. 10 pp. 674 to 679 (2011).

Ulmann's Encylopedia of Industrial Chemistry, Wiley-VCH Verlag GmbH & Co. KGaA, Weinheim, vol. 31 pp. 293 to 303 (2011).

Ulmann's Encylopedia of Industrial Chemistry, Wiley-VCH Verlag GmbH & Co. KGaA, Weinheim, vol. 1 pp. 290 to 303 (2011).

Ulmann's Encylopedia of Industrial Chemistry, Wiley-VCH Verlag GmbH Weinheim, 5th Edition, vol. A1 pp. 107 to 122 (1985).

U.S. Appl. No. 14/647,970, filed Nov. 8, 2013, 2015/0298093 A1, Oct. 22, 2015 Markowz.

U.S. Appl. No. 14/648,036, filed Nov. 8, 2013, 2015/0315936 A1, Nov. 5, 2015 Markowz.

U.S. Appl. No. 14/893,524, filed Apr. 30, 2014, 2016/0108809 A1, Apr. 21, 2016, Markowz.

U.S. Appl. No. 14/893,528, filed Apr. 30, 2014, 2016/0122194 A1, May 5, 2016 Markowz.

U.S. Appl. No. 14/898,998, filed May 20, 2014, 2016/0136608 A1, May 19, 2016, Markowz.

U.S. Appl. No. 15/021,158, filed Mar. 10, 2016, 2016/0221892, A1, Aug. 4, 2016, Markowz.

U.S. Appl. No. 15/104,969, filed Jun. 15, 2016, Moussallem.

* cited by examiner

DEVICE AND METHOD FOR THE FLEXIBLE USE OF ELECTRICITY

CROSS REFERENCE TO RELATED APPLICATIONS

The present application is U.S. national stage of international application PCT/EP2014/075881, which had an international filing date of Nov. 28, 2014, and which was published in German on Jun. 11, 2015. Priority is claimed to German application DE 10 2013 224 872.5, filed on Dec. 4, 2013. The contents of the priority application is hereby incorporated by reference in its entirety.

The present invention relates to a device and a method for flexible use of power, with which excess electrical energy can be utilized for production of hydrogen.

The use of renewable energy sources, such as wind energy and solar energy, is gaining ever-increasing significance for the generation of electricity. Electrical energy is typically supplied to a multitude of consumers over long-ranging, supra-regional and transnationally coupled electricity supply networks, referred to as electricity networks for short. Since electrical energy cannot be stored to a significant extent in the electricity network itself, the electrical power fed into the electricity network must be made to match the consumer-side power demand, known as the load. As is known, the load fluctuates time-dependently, in particular according to the time of day, the day of the week or else the time of year. For a stable and reliable electricity supply, a continuous balance of electricity generation and electricity consumption is necessary. Possibly occurring short-term deviations are balanced out by what is known as positive or negative control energy or control power. In the case of regenerative electricity-generating devices, the difficulty arises that, in the case of certain types, such as wind energy and solar energy, the energy-generating capacity is not available at all times and cannot be controlled in a specific way, but is subject to time-of-day and weather-dependent fluctuations, which only under some circumstances are predictable and which generally do not coincide with the energy demand at the particular time.

The difference between the generating capacity of fluctuating renewable energy sources and the consumption at a given time is usually covered by other power plants, such as, for example, gas, coal and nuclear power plants. With fluctuating renewable energy sources being increasingly extended and covering an increasing share of the electricity supply, ever greater fluctuations between their output and the consumption at the particular time must be balanced out. Thus, even today, not only gas power plants but increasingly also bituminous coal power plants are being operated at part load or shut down entirely in order to balance out the fluctuations. Since this variable operation of the power plants is associated with considerable additional costs, the development of alternative measures has been investigated for some time.

As an alternative or in addition to varying the output of a power plant in the case of an excess of electrical energy, a known approach is to utilize excess electrical energy for production of hydrogen by electrolytic cleavage of water. This approach has the disadvantage that a separate device for electrolytic cleavage of water has to be constructed, which is operated only in the event of an excess of electrical energy and remains unused for most of the time.

The production of chlorine by chlor-alkali electrolysis of a sodium chloride solution is one of the industrial processes with the highest power consumption. For chlor-alkali electrolysis, plants with a relatively large number of electrolysis cells operated in parallel are used in industry. Co-products typically generated in addition to chlorine are sodium hydroxide solution and hydrogen. In order to reduce the power consumption of the chlor-alkali electrolysis, methods have been developed in which there is no reduction of protons to molecular hydrogen at the cathode of the electrolysis cell, but instead reduction of molecular oxygen to water at an oxygen-consuming electrode. The plants known from the prior art for chlor-alkali electrolysis with oxygen-consuming electrodes are not designed for generation of molecular hydrogen.

There have already been proposals, for flexible use of power, to operate a chlor-alkali electrolysis in such a way that a different number of electrolysis cells is operated as a function of the power supply. This approach has the disadvantage that the amount of chlorine produced varies with the power supply and does not correspond to the current demand for chlorine, and so either a large buffer reservoir for chlorine becomes necessary or a downstream chlorine-consuming plant has to be operated with a load varying in accordance with the power supply for such an operation of a chlor-alkali electrolysis. However, intermediate storage of large amounts of chlorine, a hazardous substance, is undesirable for safety reasons and frequent operation for the chlorine-consuming plant with low load is uneconomic.

It has been found that the disadvantages of the above-mentioned devices and methods can be avoided when, in an electrolysis cell for chlor-alkali electrolysis having an oxygen-consuming electrode as cathode, the cathode half-cell is equipped with conduits for purging of the cathode half-cell, such that the cathode can be operated, as a function of the power supply, either for generation of hydrogen or for reduction of oxygen.

The invention provides a device for flexible use of power, comprising an electrolysis cell for chlor-alkali electrolysis having an anode half-cell, a cathode half-cell and a cation exchange membrane that separates the anode half-cell and the cathode half-cell from one another, an anode arranged in the anode half-cell for evolution of chlorine, an oxygen-consuming electrode arranged in the cathode half-cell as cathode, and a conduit for supply of gaseous oxygen to the cathode half-cell, wherein the device has at least one conduit for purging of the cathode half-cell with inert gas.

The invention also provides a method for flexible use of power, in which, in an inventive device, chlorine is produced by chlor-alkali electrolysis, wherein a) when power supply is low, the oxygen-consuming electrode is supplied with gaseous oxygen, and oxygen is reduced at the oxygen-consuming electrode at a first cell voltage, and b) when power supply is high, the oxygen-consuming electrode is not supplied with oxygen, and hydrogen is generated at the cathode at a second cell voltage which is higher than the first cell voltage.

The inventive device comprises an electrolysis cell for chlor-alkali electrolysis having an anode half-cell, a cathode half-cell and a cation exchange membrane that separates the anode half-cell and the cathode half-cell from one another. The inventive device may comprise a plurality of such electrolysis cells, which may be connected to form monopolar or bipolar electrolysers, preference being given to bipolar electrolysers.

An anode for evolution of chlorine is arranged in the anode half-cell of the inventive device. Anodes used may be any of the anodes known from the prior art for chlor-alkali electrolysis by the membrane method. Preference is given to using dimensionally stable electrodes having a carrier of metallic titanium and a coating with a mixed oxide composed of titanium oxide and ruthenium oxide or iridium oxide.

The anode half-cell and cathode half-cell of the inventive device are separated from one another by a cation exchange membrane. Cation exchange membranes used may be any of the cation exchange membranes known to be suitable for chlor-alkali electrolysis by the membrane method. Suitable cation exchange membranes are available under the Nafion®, Aciplex™ and Flemion™ trade names from Du Pont, Asahi Kasei and Asahi Glass.

An oxygen-consuming electrode is arranged as cathode in the cathode half-cell of the inventive device. The inventive device also has a conduit for supply of gaseous oxygen to the cathode half-cell and at least one conduit for purging of the cathode half-cell with inert gas.

Preferably, the inventive device additionally has a gas separator for separating out hydrogen formed at the cathode, and a conduit connected to said gas separator for purging of the gas separator with inert gas. The gas separator may take the form of a gas collector at the upper end of the cathode half-cell. Alternatively, the gas separator may be connected to the cathode half-cell via a conduit with which a mixture of electrolyte and hydrogen is withdrawn from the cathode half-cell.

In a preferred embodiment, the inventive device comprises electrolysers arranged in parallel. Each of the electrolysers then comprises a plurality of electrolysis cells having cathode half-cells, and a common conduit for supply of gaseous oxygen to the cathode half-cells of the electrolyser and a common conduit for purging of the cathode half-cells of the electrolyser with inert gas. In addition, the device comprises separate conduits for supply of oxygen to the electrolysers and separate conduits for supply of inert gas to the electrolysers. Each of the electrolysers preferably comprises a gas separator which is supplied with a mixture of electrolyte and hydrogen via a collecting conduit from the cathode half-cells of the electrolyser. In this embodiment, the device preferably comprises one or more conduits for supply of inert gas to the gas separators of the electrolysers. The configuration of the device with electrolysers arranged in parallel enables, with a low level of apparatus complexity, operation of the device with variability of the proportion of electrolysis cells in which hydrogen is generated.

Preferably, the oxygen-consuming electrode is arranged in the cathode half-cell such that the cathode half-cell has, between the cation exchange membrane and the oxygen-consuming electrode, an electrolyte space through which electrolyte flows, and a gas space which adjoins the oxygen-consuming electrode at a surface facing away from the electrolyte space and which can be supplied with oxygen via the conduit for supply of gaseous oxygen. Preferably, the cathode half-cell has at least one conduit for purging this gas space with an inert gas. The gas space may be continuous over the entire height of the cathode half-cell or may be divided into a plurality of gas pockets arranged vertically one on top of another, in which case the gas pockets each have orifices for pressure equalization with the electrolyte space. Suitable embodiments of such gas pockets are known to those skilled in the art, for example from DE 44 44 114 A1.

In this embodiment, the electrolyte space is preferably configured such that gas bubbles can rise between the cation exchange membrane and the oxygen-consuming electrode. For this purpose, the electrolyte space may take the form of a gap between a flat cation exchange membrane and a flat oxygen-consuming electrode, and the oxygen-consuming electrode may have elevations which abut the cation exchange membrane. Alternatively, the oxygen-consuming electrode may take the form of a corrugated or folded sheet which abuts a flat cation exchange membrane so as to form an electrolyte space in the form of channels running from the bottom upward in the corrugations or folds between the oxygen-consuming electrode and the cation exchange membrane, such that gas bubbles can ascend therein. Suitably structured oxygen-consuming electrodes are known from WO 2010/078952. The device preferably has a gas collector for hydrogen at the upper end of the electrolyte space.

Oxygen-consuming electrodes used may be noble metal-containing gas diffusion electrodes. Preference is given to using silver-containing gas diffusion electrodes, more preferably gas diffusion electrodes having a porous hydrophobic gas diffusion layer containing metallic silver and a hydrophobic polymer. The hydrophobic polymer is preferably a fluorinated polymer, more preferably polytetrafluoroethylene. More preferably, the gas diffusion layer consists essentially of polytetrafluoroethylene-sintered silver particles. The gas diffusion electrode may additionally comprise a carrier structure in the form of a mesh or grid, which is preferably electrically conductive and more preferably consists of nickel. Particularly suitable multilayer oxygen-consuming electrodes are known from EP 2 397 578 A2. Oxygen-consuming electrodes with polymer-bound silver particles have a high stability both in operation with reduction of oxygen and in operation with evolution of hydrogen. The multilayer oxygen-consuming electrodes known from EP 2 397 578 A2 can be operated with high pressure differentials and can therefore be used in a cathode half-cell with a continuous gas space over the entire height.

The inventive device preferably comprises at least one conduit with which the cathode half-cell can be supplied with inert gas, and at least one conduit with which inert gas can be withdrawn from the cathode half-cell. The conduit with which the cathode half-cell can be supplied with inert gas may be connected to the cathode half-cell separately from the conduit for supply of gaseous oxygen, or it may be connected to the conduit for supply of gaseous oxygen upstream of the cathode half-cell, such that the conduit section between this connection and the cathode half-cell can be purged with inert gas. The conduit with which inert gas can be withdrawn from the cathode half-cell may be connected to a gas collector at the upper end of the electrolyte space or may be connected to a separating device which is arranged outside the cathode half-cell and in which gas is separated from electrolyte flowing out of the cathode half-cell. Preferably, sensors with which the content of oxygen and hydrogen in the gas withdrawn can be measured are arranged at the conduit with which inert gas can be withdrawn from the cathode half-cell.

The gas space adjoining the oxygen-consuming electrode, any gas pockets present, any gas collector present and the conduits connected to the cathode half-cell for supply and withdrawal of gases are preferably configured such that only low backmixing of gas occurs when purging the cathode half-cell with inert gas. The gas space, any gas pockets present and any gas collector present are therefore configured with minimum gas volumes.

The inventive device may additionally have a buffer reservoir for chlorine generated in the anode half-cell, which can store an amount of chlorine which can compensate for the interruption in the generation of chlorine in the anode half-cell on purging of the cathode half-cell with inert gas.

In the inventive method for flexible use of power, chlorine is produced by chlor-alkali electrolysis in a device according to the invention and at least one electrolysis cell in the device is operated with different cell voltages as a function of the power supply. When power supply is low, the oxygen-consuming electrode of the electrolysis cell is supplied with gaseous oxygen, and oxygen is reduced at the oxygen-consuming electrode at a first cell voltage. When power supply is high, the oxygen-consuming electrode is not supplied with oxygen, and hydrogen is generated at the cathode at a second cell voltage which is higher than the first cell voltage.

A high power supply may result from a power surplus, and a low power supply may result from a power deficit. A power surplus arises when at some point more power from renewable energy sources is being provided than the total amount of power being consumed at this time. A power surplus also arises when large amounts of electrical energy are being provided from fluctuating renewable energy sources, and the throttling or shutdown of power plants is associated with high costs. A power deficit arises when comparatively small amounts of renewable energy sources are available and inefficient power plants, or power plants associated with high costs, have to be operated. A power surplus may also exist when the operator of a power generator, for example of a windfarm, is producing more power than has been predicted and sold. Analogously, a power deficit may exist when less power is being produced than predicted. The distinction between a high power supply and a low power supply can alternatively also be made on the basis of a price at a power exchange, in which case a low power price corresponds to a high power supply and a high power price to a low power supply. In this case, for the distinction between a high power supply and a low power supply, it is possible to use a fixed or a time-variable threshold value for the power price at a power exchange.

In a preferred embodiment, a threshold value for a power supply is defined for the inventive method. In that case, the current power supply is determined at regular or irregular intervals and the electrolysis cell is operated with the first cell voltage with supply of gaseous oxygen to the oxygen-consuming electrode when the power supply is below the threshold value, and with the second cell voltage without supply of oxygen to the oxygen-consuming electrode when the power supply is above the threshold value. The threshold value for the power supply and the current power supply can, as described above, be defined or ascertained on the basis of the difference between power generation and power consumption, on the basis of the current output of a power generator, or on the basis of the power price at a power exchange.

By changing between two modes of operation with different cell voltage, it is possible in the inventive method to match the power consumption of the chlor-alkali electrolysis flexibly to the power supply, without any need for alteration of the production output of chlorine and for intermediate storage of chlorine for that purpose. The electrical energy consumed additionally as a result of the higher second cell voltage is used for generation of hydrogen and enables storage of surplus power in the form of chemical energy without the construction and operation of additional installations for power storage. This way, more hydrogen is generated per additional kWh consumed than in the case of hydrogen generation by water electrolysis.

Suitable values for the first cell voltage for reduction of oxygen at the oxygen-consuming electrode and for the second cell voltage for production of hydrogen at the electrode depend on the design of the oxygen-consuming electrode used and on the current density envisaged for the chlor-alkali electrolysis, and can be ascertained in a known manner by the measurement of current-voltage curves for the two modes of operation.

The gaseous oxygen can be supplied in the form of essentially pure oxygen or in the form of oxygen-rich gas, in which case the oxygen-rich gas contains preferably more than 50% by volume of oxygen and more preferably more than 80% by volume of oxygen. Preferably, the oxygen-rich gas consists essentially of oxygen and nitrogen, and may optionally additionally contain argon. A suitable oxygen-rich gas can be obtained from air by known methods, for example by pressure swing adsorption or a membrane separation.

Preferably, when changing from hydrogen generation at the second cell voltage to oxygen reduction at the first cell voltage, the cell voltage is reduced until essentially no more current flows, and the cathode half-cell is purged with an inert gas, before gaseous oxygen is supplied to the oxygen-consuming electrode. Analogously and preferably, when changing from oxygen reduction at the first cell voltage to hydrogen generation at the second cell voltage, the cell voltage is reduced until essentially no more current flows, and the cathode half-cell is purged with an inert gas, before hydrogen is generated at the cathode. Suitable inert gases are all gases which do not form ignitable mixtures either with oxygen or with hydrogen and which do not react with aqueous sodium hydroxide solution. The inert gas used is preferably nitrogen. Preferably, purging with inert gas and maintenance of a reduced cell voltage is continued until the content of hydrogen or oxygen in the gas which leaves the cathode half-cell because of the purging falls below a defined limit. The limit for hydrogen is preferably selected such that mixing of the hydrogen containing gas with pure oxygen cannot give a flammable mixture, and the limit for oxygen is preferably selected such that mixing of the oxygen containing gas with pure hydrogen cannot give a flammable mixture. Suitable limits can be taken from known diagrams for the flammability of gas mixtures, or be ascertained by methods known to those skilled in the art for determining flammability. The reduction in the cell voltage and the purging with inert gas can reliably avoid the formation of flammable gas mixtures when changing between the two modes of operation of the inventive method.

When changing from hydrogen generation at the second cell voltage to oxygen reduction at the first cell voltage, the purging with inert gas is preferably additionally followed by purging with an oxygen containing gas, in order to avoid mass transfer inhibition in the reduction of oxygen as a result of a high content of inert gas in the gas diffusion layer of the oxygen-consuming electrode.

Preferably, a prediction of the expected power supply is made for the method of the invention, a minimum duration for operation with the first and with the second cell voltage is set, and a switchover between operation with the first cell voltage with supply of gaseous oxygen to operation with the second cell voltage without supply of oxygen is performed only when the predicted duration of a low or high power supply is longer than the minimum duration set. Through such a mode of operation, it is possible to avoid losses of production capacity for chlorine as a result of too many changes of the cell voltage and associated interruptions in chlorine production during purging with inert gas.

In a preferred embodiment of the inventive method, after changing from oxygen reduction at the first cell voltage to hydrogen generation at the second cell voltage, a gas mixture comprising hydrogen and inert gas is withdrawn from the cathode half-cell and hydrogen is separated from this gas mixture, preferably through a membrane. With such a separation, essentially all the hydrogen generated can be obtained in high purity and with constant quality.

Preferably, the method of the invention is performed in a device having a plurality of electrolysis cells according to the invention, and the proportion of electrolysis cells to which no oxygen is supplied and in which hydrogen is generated at the cathode is altered as a function of the power supply. More preferably, for this purpose, the device described above with a plurality of electrolysers arranged in parallel is used. This allows for adjusting the power consumption of the chlor-alkali electrolysis within a wide range with essentially constant chlorine production. In this embodiment, the method of the invention can be used, without any adverse effects on chlorine production, for providing negative control energy for the operation of a power distribution grid.

The invention claimed is:

1. A method for flexible use of electrical power, wherein chlorine is produced by chlor-alkali electrolysis in a device comprising an electrolysis cell for chlor-alkali electrolysis having an anode half-cell, a cathode half-cell and a cation exchange membrane that separates the anode half-cell and the cathode half-cell from one another, an anode arranged in the anode half-cell for evolution of chlorine, an oxygen-consuming electrode arranged in the cathode half-cell as cathode, and a conduit for supply of gaseous oxygen to the cathode half-cell, wherein the device has at least one conduit for purging of the cathode half-cell with inert gas and wherein:

a) when power supply is low, the oxygen-consuming electrode is supplied with gaseous oxygen, and oxygen is reduced at the oxygen-consuming electrode at a first cell voltage; and b) when power supply is high, the oxygen-consuming electrode is not supplied with oxygen, and hydrogen is generated at the cathode at a second cell voltage which is higher than the first cell voltage.

2. The method of claim 1, wherein, when changing from hydrogen generation at the second cell voltage, to oxygen reduction at the first cell voltage, the cell voltage is reduced until essentially no current flows, and the cathode half-cell is purged with an inert gas before gaseous oxygen is supplied to the oxygen-consuming electrode.

3. The method of claim 1, wherein, when changing from oxygen reduction at the first cell voltage to hydrogen generation at the second cell voltage, the cell voltage is reduced until essentially no current flows and the cathode half-cell is purged with an inert gas before hydrogen is generated at the cathode.

4. The method of claim 1, comprising the steps of:

a) defining a threshold value for a power supply;

b) determining the power supply;

c) operating the electrolysis cell with the first cell voltage with supply of gaseous oxygen to the oxygen-consuming electrode when the power supply is below the threshold value and operating the electrolysis cell with the second cell voltage without supply of oxygen to the oxygen-consuming electrode when the power supply is above the threshold value; and d) repeating steps b) and c).

5. The method of claim 1, wherein nitrogen is used as the inert gas.

6. The method of claim 1, wherein, after a switchover from oxygen reduction at the first cell voltage to hydrogen generation at the second cell voltage, a gas mixture comprising hydrogen and inert gas is withdrawn from the cathode half-cell and hydrogen is separated from this gas mixture through a membrane.

7. The method of claim 1, wherein said device has a plurality of electrolysis cells and the proportion of the electrolysis cells to which no oxygen is supplied and in which hydrogen is generated at the cathode is altered as a function of the power supply; and wherein each electrolysis cell comprises an anode half-cell, a cathode half-cell and a cation exchange membrane that separates the anode half-cell and the cathode half-cell from one another, an anode arranged in the anode half-cell for evolution of chlorine, an oxygen-consuming electrode arranged in the cathode half-cell as cathode, and a conduit for supply of gaseous oxygen to the cathode half-cell, wherein the device has at least one conduit for purging of the cathode half-cell with inert gas.

8. The method of claim 1, wherein a prediction of the expected power supply is made, a minimum duration for operation with the first and with the second cell voltage is set, and a switchover between operation with the first cell voltage with supply of gaseous oxygen to operation with the second cell voltage without supply of oxygen is performed only when the predicted duration of a low or high power supply is longer than the minimum duration set.

9. The method of claim 1, wherein, in said device:

a) the cathode half-cell comprises an electrolyte space through which electrolyte flows between the cation exchange membrane and the oxygen-consuming electrode;

b) a gas space, to which oxygen can be supplied via the conduit for supply of gaseous oxygen, adjoins the oxygen-consuming cathode at a surface facing away from the electrolyte; and c) the cathode half-cell comprises at least one conduit for purging said gas space with an inert gas.

10. The method of claim 9, wherein the gas space in said device is divided into a plurality of gas pockets arranged vertically one on top of another and the gas pockets each have orifices for pressure equalization with the electrolyte space.

11. The method of claim 9, wherein said device further comprises a gas collector for hydrogen at the upper end of the electrolyte space.

12. The method of claim 9, wherein said device further comprises a conduit with which inert gas can be withdrawn from the cathode half-cell, and sensors arranged at this conduit with which the content of oxygen and hydrogen in the inert gas can be measured.

13. The method of claim 1, wherein said device further comprises a plurality of electrolysers that are arranged in parallel, each of the electrolysers comprising a plurality of electrolysis cells having cathode half-cells, and a common conduit for supply of gaseous oxygen to the cathode half-cells of the electrolyser and a common conduit for purging of the cathode half-cells of the electrolyser with inert gas, and the device comprises separate conduits for supply of oxygen to the electrolysers and separate conduits for supply of inert gas to the electrolysers.

14. The method of claim 1, wherein, in said device, the oxygen-consuming electrode comprises a porous hydrophobic gas diffusion layer containing metallic silver and a fluorinated polymer.

15. The method of claim 4, wherein, when changing from hydrogen generation at the second cell voltage, to oxygen reduction at the first cell voltage, the cell voltage is reduced until essentially no current flows, and the cathode half-cell is purged with an inert gas before gaseous oxygen is supplied to the oxygen-consuming electrode.

16. The method of claim 15, wherein, when changing from oxygen reduction at the first cell voltage to hydrogen generation at the second cell voltage, the cell voltage is reduced until essentially no current flows and the cathode half-cell is purged with an inert gas before hydrogen is generated at the cathode.

17. The method of claim 16, wherein said device has a plurality of electrolysis cells and the proportion of the electrolysis cells to which no oxygen is supplied and in which hydrogen is generated at the cathode is altered as a function of the power supply; and wherein each electrolysis cell comprises an anode half-cell, a cathode half-cell and a cation exchange membrane that separates the anode half-cell and the cathode half-cell from one another, an anode arranged in the anode half-cell for evolution of chlorine, an oxygen-consuming electrode arranged in the cathode half-cell as cathode, and a conduit for supply of gaseous oxygen to the cathode half-cell, wherein the device has at least one conduit for purging of the cathode half-cell with inert gas.

18. The method of claim 16, wherein a prediction of the expected power supply is made, a minimum duration for operation with the first and with the second cell voltage is set, and a switchover between operation with the first cell voltage with supply of gaseous oxygen to operation with the second cell voltage without supply of oxygen is performed only when the predicted duration of a low or high power supply is longer than the minimum duration set.

19. The method of claim 16, wherein, in said device:

a) the cathode half-cell comprises an electrolyte space through which electrolyte flows between the cation exchange membrane and the oxygen-consuming electrode;

b) a gas space, to which oxygen can be supplied via the conduit for supply of gaseous oxygen, adjoins the oxygen-consuming cathode at a surface facing away from the electrolyte; and c) the cathode half-cell comprises at least one conduit for purging said gas space with an inert gas.

20. The method of claim 19, wherein nitrogen is used as the inert gas.

* * * * *